United States Patent [19]

Sitarz

[11] 4,161,186

[45] Jul. 17, 1979

[54] DOWNSPOUT RECEIVER AND WATER DISPENSING DEVICE

[76] Inventor: Charles L. Sitarz, Box 7, R.R. #2, Dugald, Canada

[21] Appl. No.: 839,645

[22] Filed: Oct. 5, 1977

[30] Foreign Application Priority Data

Oct. 18, 1976 [CA] Canada ..... 264003

[51] Int. Cl.[2] ..... E04D 13/08

[52] U.S. Cl. ..... 137/357; 137/356; 239/201

[58] Field of Search ..... 51/16; 137/356, 357, 137/533.29; 239/201, 208, 453, 454

[56] References Cited

U.S. PATENT DOCUMENTS

| | | | |
|---|---|---|---|
| 1,151,089 | 8/1915 | Dietsch | 239/454 |
| 1,152,225 | 8/1915 | Ryan | 239/453 |
| 1,693,556 | 11/1928 | Spencer | 239/208 |
| 1,758,119 | 5/1930 | Le Moon | 239/453 X |
| 1,845,618 | 2/1932 | Miller | 239/454 |
| 2,996,077 | 8/1961 | Taggert | 239/453 UX |
| 3,397,842 | 8/1968 | Frandsen | 239/453 X |
| 3,603,340 | 9/1971 | Rousselet | 137/357 |

*Primary Examiner*—Gerald A. Michalsky
*Attorney, Agent, or Firm*—Stanley G. Ade

[57] ABSTRACT

A hollow cylinder or tube is buried in the ground with the upper end flush with or adjacent to the surface and a downspout from a building is connected underground through the wall of the cylinder to the interior thereof. A disc-like cover is mounted on the upper end of the cylinder for vertical movement so that when water passes through the downspout to the cylinder, the pressure moves the cover upwardly and allows the water to disperse around the periphery of the cylinder. When water stops flowing, the cover retracts upon the cylinder and seals it against the ingress of leaves, dirt and the like.

2 Claims, 3 Drawing Figures

DOWNSPOUT RECEIVER AND WATER DISPENSING DEVICE

BACKGROUND OF THE INVENTION

This invention relates to new and useful improvements in downspout receivers and water dispensing devices.

Most towns and cities require that downspouts be disconnected from the main sewer system of the building and instead be arranged so that they discharge outwardly from the building in order to prevent overloading of the sewer system.

Such downspouts normally discharge upon driveways, flower beds or the like and it is quite common to provide a substantially horizontal connecting tube from the lower end of the downspout, across the flower bed to a point remote from the building in order to prevent overloading of the weeping tiles normally situated around the footings of the building.

Not only are these horizontally extending tubes unsightly, but where they discharge upon a lawn or other cultivated ground, it is quite normal to find washed away furrows or the like, particularly after heavy rains.

SUMMARY OF THE INVENTION

The present invention overcomes these disadvantages by providing a substantially hollow receiver which is buried in the ground remote from the lower end of the downspout and is connected to the downspout by buried conduit.

A pop-up type lid or cover is provided which normally rests flush upon the upper end of the receiver level with the ground, but which moves upwardly under water pressure when water is flowing through the downspout. This water is then discharged circumferentially around the periphery of the receiver so that wash-aways are prevented. When the water pressure drops, the lid or cover returns to the closed position by gravity or by a light spring if desired, thereby preventing the ingress of dirt, dust and the like into the receiver and also preventing accidents from occuring to people who might be walking in the general area of the receiver.

One aspect of the invention is therefore to provide a downspout receiver and water dispensing device adapted to be used with a downspout of the like and to be connected to the downspout and which comprises a rain water receiver operatively connectable to the lower discharge end of the downspout assembly. Cover means are provided for the upper end of the receiver, said cover means normally closing off said upper end. Means are provided to mount the cover means for water egress therepast whereby water pressure within the receiver opens the cover and allows discharge to occur around the perimeter of the receiver.

The device is readily connectable to a downspout assembly and is unobtrusive when in position and does not interfere with the cutting of grass by conventional mower means because, when closing the cover is substantially flush with the ground surface.

The device is simple in construction, economical in operation and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 3:
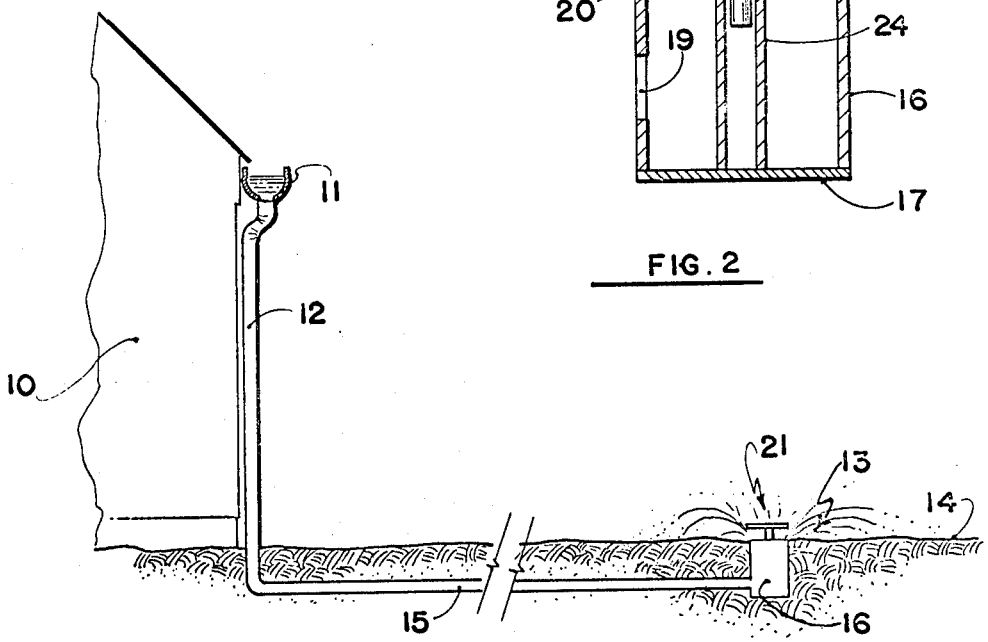
FIG. 3 is a schematic partial section showing one method of installing the receiver and connecting same to a downspout assembly.

Proceeding therefore to describe the invention in detail, reference should first be made to FIG. 3 in which 10 illustrates a building having an eavestrough 11 and a downspout 12 connected thereto.

The receiver assembly collectively designated 13 is preferably buried within the ground 14 at a location remote from the downspout 12 and is connected to the lower end of the downspout by means of a connecting conduit 15 which may take the form of downspout material or plastic tubing as desired, it being understood that this connecting conduit is also buried below the ground level 14.

In detail, the preferred embodiment of the invention comprises a receiver 16 taking the form of a metal or synthetic plastic cylinder situated vertically and having a closed lower end 17 formed or secured thereto. The upper end 18 is open and an aperture 19 is formed through the vertical wall 20 of the receiver adjacent the lower end 17 thereof to which the afore-mentioned conduit 15 may be connected so that any water passing down the downspout 12, is fed by the conduit 15 to the interior of the receiver 16.

The upper end 18 of the receiver is preferably level or substantially flush with the ground surface 14 and cover means collectively designated 21 are provided which normally closes off the open upper end 18.

In this embodiment, the cover means comprises a disc 22 having a stem 23 secured to the underside thereof and extending downwardly therefrom, said stem preferably being mounted in a central location to the cover 22.

A tubular guide 24 extends centrally upwardly from the base 17 of the receiver 16 and terminates just short of the upper end 18 thereof and this tubular guide is maintained in position by means of a spider 25 extending from the sides of the tubular guide 24 to the inner surface of the vertical wall 20 of the receiver.

The stem 23 is slidably engageable within the guide means or tube 24 and the cover 22 normally engages the upper periphery 26 of the open upper end of the receiver 16.

Figure 1:
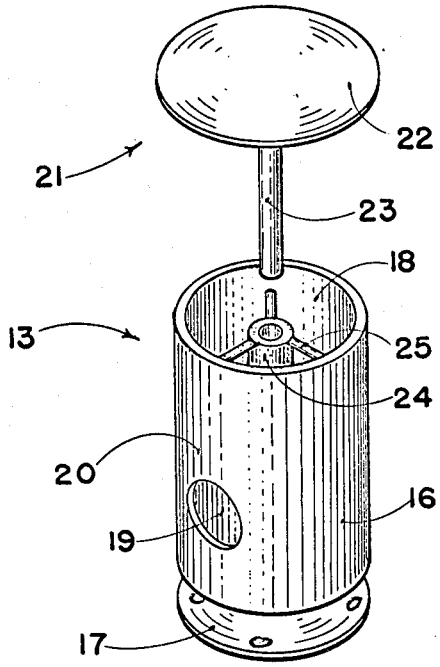
FIG. 1 is an isometric exploded view of the receiver per se.
Figure 2:
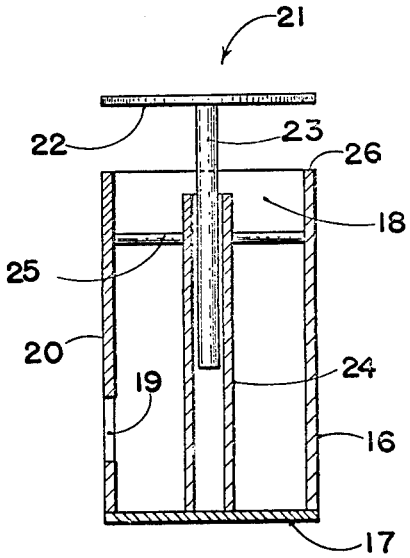
FIG. 2 is a partially sectioned view of the assembled receiver with the cover in the raised position.

However, when water passes downwardly through the downspout 12, it enters the receiver 16 through the aperture 19 and the pressure of this water moves the cover 22 upwardly to a location substantially as illustrated, as an example, in FIGS. 2 and 3. This allows the water to be discharged circumferentially around the receiver onto the ground without causing a wash-away area as the pressure has been released by the lifting of the cover means 21 and the water is discharged over a larger area.

When the water ceases discharging, the weight of the cover and tube 23 causes the cover to move downwardly and once again close the upper open end of the receiver.

Although the receiver is shown as being cylindrical in the drawings, nevertheless it will be appreciated that any convenient configuration can be utilized, it being understood that the cover is shaped similarly so that it closes the open upper end under normal conditions.

When installing the device it is preferable to place a layer of gravel or the like under and around the base of the receiver in order to facilitate drainage.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A downspout receiver and water dispensing device adapted to be used with a downspout having a lower discharge end and having connecting means between the downspout and said receiver; comprising in combination a rain water receiver operatively connected to the lower discharge end of a downspout, cover means for the upper end of said receiver, said cover means normally closing off said upper end of said receiver, and means mounting said cover means for water egress therepast whereby water pressure within said receiver opens said cover, said receiver being adapted to be buried underground remote from the associated downspout, said receiver consisting of a container having a closed lower end and an open upper end with the open upper end normally being located flush with the surface of the ground, and an aperture formed in the wall of said container adjacent said closed lower end to receive the associated connecting means from the downspout, said cover means comprising a disc normally engaging the open upper end of said receiver.

2. The device according to claim 1 in which said means mounting said cover for water egress therepast comprises a vertically situated tubular guide mounted centrally within said receiver, and a stem extending downwardly from said cover means and engaging said tubular guide for vertical sliding movement therein.

* * * * *